US010617241B2

(12) United States Patent
Alletto, Jr.

(10) Patent No.: US 10,617,241 B2
(45) Date of Patent: Apr. 14, 2020

(54) SYSTEMS AND METHODS IN SUPPORT OF BEDDING SELECTION AT A RETAIL LOCATION

(71) Applicant: BEDGEAR, LLC, Farmingdale, NY (US)

(72) Inventor: Eugene Alletto, Jr., Glen Head, NY (US)

(73) Assignee: Bedgear, LLC, Farmingdale, NY (US)

( * ) Notice: Subject to any disclaimer, the term of this patent is extended or adjusted under 35 U.S.C. 154(b) by 0 days.

(21) Appl. No.: 15/801,599

(22) Filed: Nov. 2, 2017

(65) Prior Publication Data

US 2018/0132634 A1 May 17, 2018

Related U.S. Application Data

(63) Continuation of application No. 13/276,027, filed on Oct. 18, 2011, now Pat. No. 9,895,010.

(60) Provisional application No. 61/394,308, filed on Oct. 18, 2010.

(51) Int. Cl.

| | |
|---|---|
| ***A47G 9/00*** | (2006.01) |
| ***G09F 23/06*** | (2006.01) |
| ***A47G 9/10*** | (2006.01) |
| ***A47F 7/00*** | (2006.01) |
| ***G09F 23/00*** | (2006.01) |
| *A47G 9/02* | (2006.01) |

(52) U.S. Cl.

CPC ..... *A47G 9/10* (2013.01); *A47F 7/00* (2013.01); *G09F 23/00* (2013.01); *A47G 9/0238* (2013.01); *A47G 9/0253* (2013.01); *A47G 9/1054* (2013.01); *A47G 2009/1018* (2013.01)

(58) Field of Classification Search

CPC . A47G 9/10; A47G 9/0253; A47G 2009/1018
See application file for complete search history.

(56) References Cited

U.S. PATENT DOCUMENTS 1,891,629 A * 12/1932 Van Wagner ..... A61G 7/0502 225/84
3,318,632 A * 5/1967 Struble ..... A47C 7/386 297/220
3,761,973 A * 10/1973 Leventhal ..... A61F 5/485 5/484
3,804,458 A * 4/1974 Jannoni ..... A47C 7/386 297/220

(Continued)

*Primary Examiner* — Shin H Kim
(74) *Attorney, Agent, or Firm* — Sorell, Lenna & Schmidt, LLP

(57) ABSTRACT

In one aspect, a system and method are provided herein in support of selecting bedding. The system includes a plurality of differently configured pillows; and, a plurality of pillow cover napkins each configured to rest upon one of the pillows in acting as a cleanliness barrier for a person's head resting on the pillow. Advantageously, the system allows for a user to sample various bedding, including mattresses and/or pillows, in a hygienic manner. In particular, the system allows for a user to select a pillow from the differently configured pillows which is suited to one's preferences to use in sampling various mattresses. The napkin is placed by the user atop the selected pillow in sampling the mattresses. The napkin acts as a cleanliness barrier between the user's head and the sampled bedding. A person's comfort level in sampling mattresses and/or pillows may be heightened in this manner.

20 Claims, 7 Drawing Sheets

(56) References Cited

U.S. PATENT DOCUMENTS 3,916,447 A * 11/1975 Thompson ..... A41B 13/10 2/46
4,056,281 A * 11/1977 Byrnes ..... A47C 7/386 297/220
4,067,609 A * 1/1978 Ness ..... A47C 7/386 297/220
5,084,927 A * 2/1992 Parkevich ..... A47G 9/02 5/484
5,148,706 A 9/1992 Masuda et al.
5,445,874 A * 8/1995 Shehata ..... A41D 31/0016 442/287
5,540,354 A * 7/1996 Annand ..... A47K 10/423 206/449
5,548,858 A * 8/1996 Shoa ..... A47G 9/02 40/675
5,727,266 A * 3/1998 Pang ..... A47G 9/0253 5/490
6,236,816 B1 * 5/2001 Warbus ..... G03G 15/22 399/46
6,256,816 B1 * 7/2001 Law ..... A47G 9/0207 5/482
6,571,192 B1 5/2003 Hinshaw et al.
6,585,328 B1 7/2003 Oexman et al.
6,741,950 B2 5/2004 Hinshaw et al.
6,997,070 B2 2/2006 Killingbeck
7,124,652 B2 10/2006 Killingbeck
7,467,058 B2 12/2008 Boyd
7,695,066 B2 * 4/2010 Guercia ..... A47C 31/11 297/219.1
RE41,809 E 10/2010 Hinshaw et al.
7,937,238 B2 5/2011 Boyd
7,937,239 B2 5/2011 Boyd
8,117,700 B2 2/2012 Howard
2011/0214233 A1 * 9/2011 Stang ..... A47C 21/028 5/488
2012/0180214 A1 7/2012 Borgione

* cited by examiner

SYSTEMS AND METHODS IN SUPPORT OF BEDDING SELECTION AT A RETAIL LOCATION

CROSS-REFERENCE TO RELATED APPLICATION

This application is a continuation application of U.S. patent application Ser. No. 13/276,027, filed Oct. 18, 2011, which claims priority to U.S. Provisional Patent Appl. No. 61/394,308, filed Oct. 18, 2010. These applications are incorporated by reference herein, in their entireties.

BACKGROUND OF THE INVENTION

Bedding products, including mattresses, pillows, mattress protectors, and so forth, are typically sold in showroom style stores where the products are on display to be sampled. The intent is for customers to sample the products in the same manner as they would sleep on them. For example, mattresses are made available for customers to lie on to test for comfort. However, many people, due to concerns over hygiene and possible disease transmission, do not feel sufficiently comfortable in sampling the products as intended. These individuals are inhibited by concerns over public use.

SUMMARY OF THE INVENTION

In one aspect, a system and method are provided herein in support of selecting bedding. The system includes a plurality of differently configured pillows; and, a plurality of pillow cover napkins each configured to rest upon one of the pillows in acting as a cleanliness barrier for a person's head resting on the pillow. Advantageously, the system allows for a user to sample various bedding, including mattresses and/or pillows, in a hygienic manner. In particular, the system allows for a user to select a pillow from the differently configured pillows which is suited to one's preferences to use in sampling various mattresses. The napkin is placed by the user atop the selected pillow in sampling the mattresses. The napkin acts as a cleanliness barrier between the user's head and the sampled bedding. A person's comfort level in sampling mattresses and/or pillows may be heightened in this manner.

In further aspects of the subject invention, a method of categorizing mattresses for convenience of customers at a retail location is provided herein. This method may aid customers who are interested in identifying and sampling mattresses of a particular category. Also, a selection of mattress protectors may be made available to choose from by a customer. Swatches of the mattress protectors may be made available for touch and inspection by customers.

These and other features of the invention will be better understood through a study of the following detailed description and accompanying drawings.

DESCRIPTION OF THE INVENTION

Various systems and methods in support of selecting bedding at a retail location are provided herein. The systems and methods are particularly well-suited for use in showroom style retail locations. Although the main focus herein is on the selection of mattresses, as will be appreciated by those skilled in the art, the subject invention may be also applied to the selection of other bedding.

Figure 1:
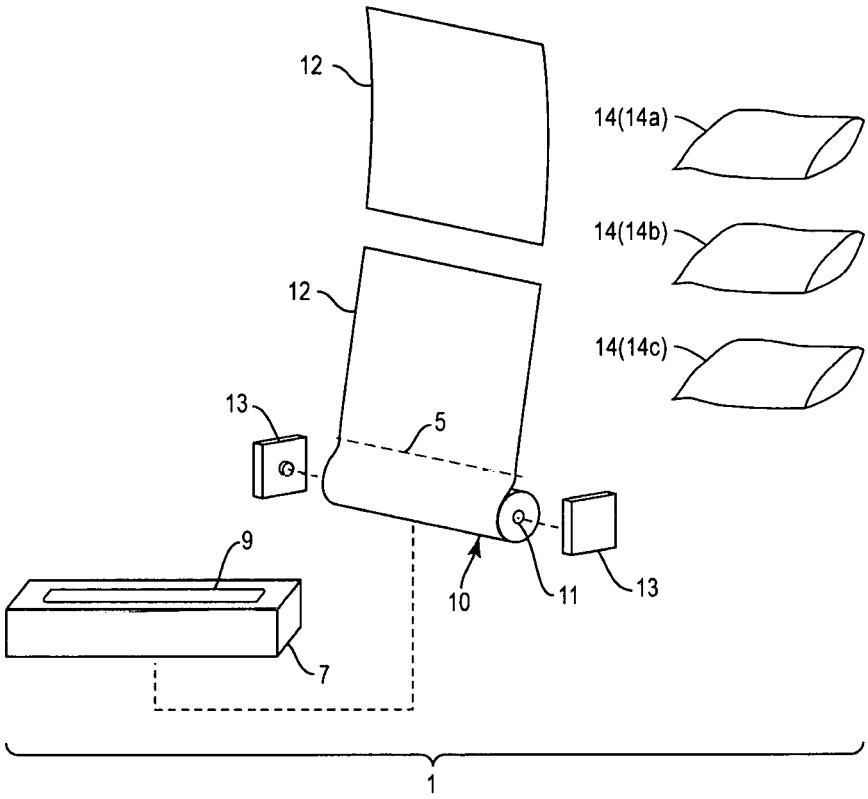
FIG. 1 is a schematic of a system formed in accordance with the subject invention.
Figure 2:
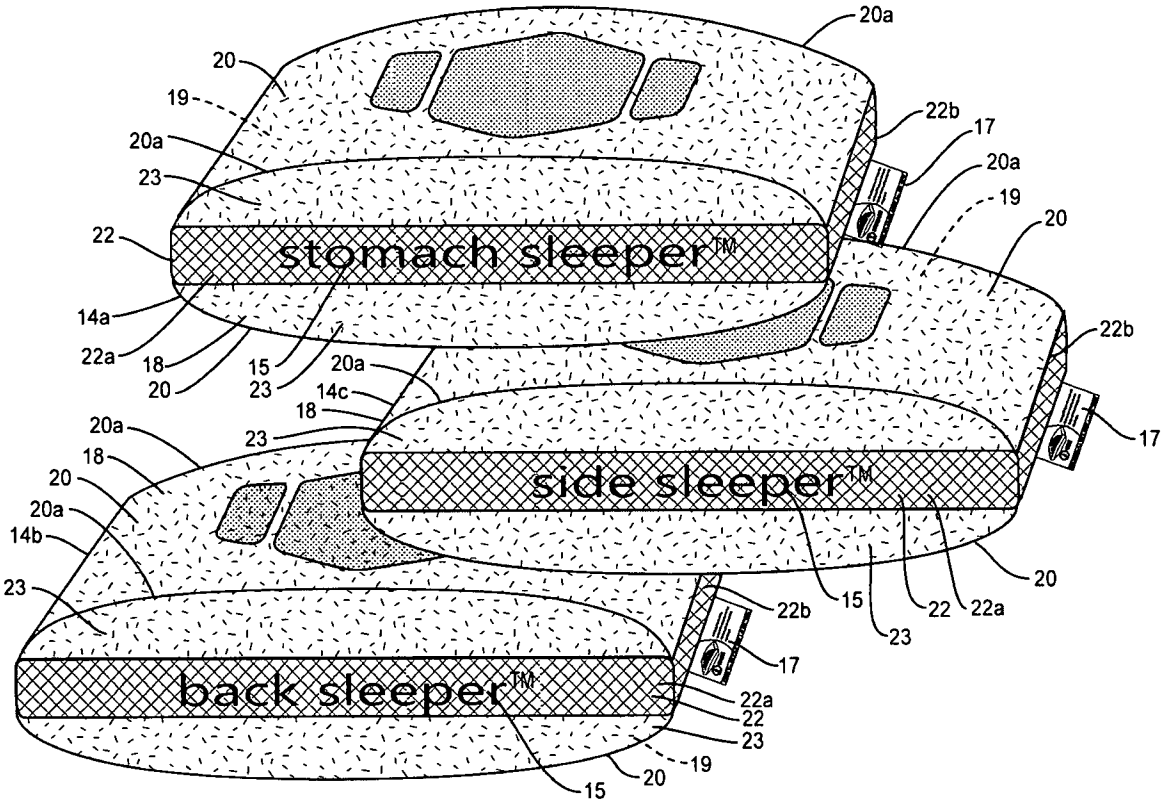
FIG. 2 depicts pillows useable with the subject invention.

In a first aspect, with reference to FIGS. 1-3, a system 1 is provided which may be used in support of selecting bedding. The system 1 includes a supply 10 of pillow cover napkins 12 and a plurality of differently-configured pillows 14. The napkins 12 are sheets of flexible material, such as textile, paper or other cellulosic-based material, or combinations thereof, sized and shaped to act as a cleanliness barrier for a person's head for resting on a pillow. For example, the napkins 12 may be made of non-woven polyester fibers. Alternatively, biodegradable materials may be used, such as corn-based fiber material. Also, the napkins 12 may be provided with colors, scents and/or prints to enhance appearance and/or to convey a message. Preferably, the napkins 12 are intended for single-use with disposal thereof. The supply 10 may provide the napkins 12 as a collection in roll or other form (e.g., stack). The napkins 12 may be provided from the supply 10 as separate (unjoined) sheets or as joined sheets, for example being tearable from a roll or a continuous sheet. Preferably, as joined, for example with the supply 10 being a roll or continuous sheet, the supply 10 includes lines of weakness 5, e.g., perforations, to ease separation of the napkins 12. Alternatively, the supply 10 may be formed continuously without lines of weakness, whereby users forcibly tear portions of the supply 10 to obtain the napkins 12.

A plurality of the napkins 12 may be packaged together in a container 7. The container 7 may define a nip 9 to permit removal of the napkins 12. If the napkins 12 are provided in roll form, the napkins 12 may be wound on a core 11. The core 11 is preferably enclosed in the container 7 with the nip 9 being defined through which the napkins 12 may be removed. The core 11 may be rotatably supported, e.g., by end plates 13, to ease removal of the napkins 12.

The pillows 14 are preferably of different constructions, each separately configured to accommodate various sleep positions. The plurality of pillows 14 may include: a pillow 14*a* configured for head support and open airway with an individual sleeping on their stomach; a pillow 14*b* configured for head, neck and skull base support with an individual sleeping on their back; and, a pillow 14*c* configured for head support, with general avoidance of neck compression, with an individual sleeping on their side. In particular, the pillow 14*c* may be formed with greater thickness and rigidity, so as to be more lofty and structured, than the pillows 14*a* and 14*b*, to provide higher support for a person's head during sleep on their side such that sufficient head support is provided against neck compression (e.g., sufficient fill is provided against the shoulder line to avoid neck compression); the pillow 14*a* may be formed softer than the pillows 14*b* and 14*c* to accommodate a person's head and face, e.g. by conforming to a person's facial features, when sleeping on their stomach as opposed to their back; and, the pillow 14*b* may be formed more flat and firm than the pillows 14*a* and 14*c* to minimize stress on a person's neck and back while sleeping on their back.

Different fills are possible for each of the pillows 14*a*, 14*b*, 14*c*. The fills may be blends of hypoallergenic polyester fibers to achieve different levels of support versus softness as described above. For example, the pillow 14*a*, intended for a stomach sleeping position, may be provided with a fill of microfiber; the pillow 14*b*, intended for a back sleeping position, may be provided with a fill of a blend of conjugate and hollow slick fiber; and, the pillow 14*c*, intended for a side sleeping position, may be provided with a fill of cluster/ball fiber. As will be appreciated by those skilled in the art, other fills are possible. Various down, memory foam (solids and/or clusters) and/or latex (solids and/or springs), in varying combinations, may be utilized with the pillows 14 herein.

The pillows 14 are preferably labeled to provide indication of their characteristic. For example, the pillows 14 may be provided with covers 18 which enclose compliant fill material 19. The covers 18 may include indicia 15, e.g., by embroidery, to indicate the intended use of the respective pillows. For example, the pillow 14*a* may be marked to indicate that it is configured for sleeping on your stomach, the pillow 14*b* may be marked to indicate that it is intended for sleeping on your back, while the pillow 14*c* may be marked that it is intended for sleeping on your side.

Figure 3A:
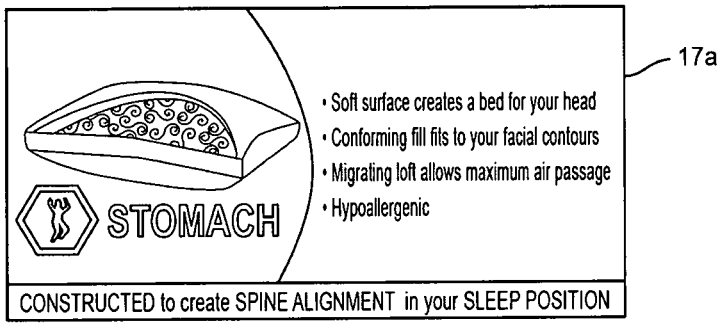
FIGS. 3*a*-3*c* show labels useable with the subject invention.
Figure 3B:
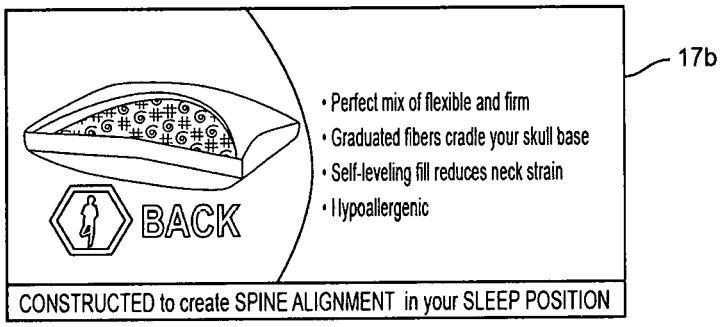
Figure 3C:
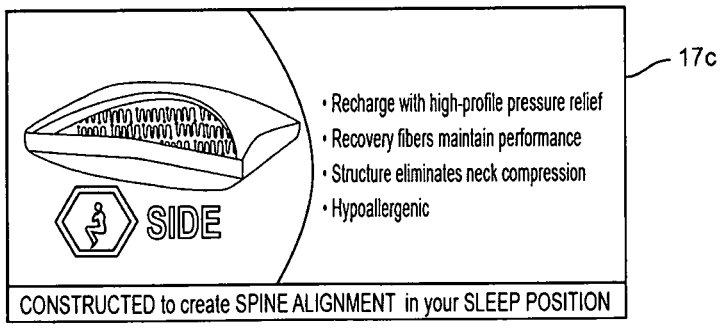

The pillows 14 may also include one or more labels 17 which provide additional and/or explanatory information regarding the respective pillow 14. The labels 17 may be embroidered or marked otherwise directly onto the pillows 14. Preferably, the labels 17 are individual pieces of sheet material (e.g., paper, and/or textile) which are affixed to the pillows 14 in any known technique, such as by sewing, gluing, mechanically fastened, and so forth. FIGS. 3*a*-*c* include non-limiting examples of the labels 17 which may be used with the pillows 14. FIG. 3*a* shows a label 17*a* including information as to how the pillow 14*a*, configured for one who sleeps on their stomach, is intended to perform; FIG. 3*b* shows a label 17*b* including information as to how the pillow 14*b*, configured for one who sleeps on their back, is intended to perform; and, FIG. 3*c* shows a label 17*c* including information as to how the pillow 14*c*, configured for one who sleeps on their side, is intended to perform.

The covers 18 may each include opposing panels 20 bound, and connected, by gussets 22. The indicia 15 and the labels 17 are preferably located on the gussets 22 so as to be readable with the pillows 14 being stacked (FIG. 2).

The panels 20 are intended to accept a user's head to provide support therefor. More preferably, the panels 20 are formed generally rectangular and are bounded by the gussets 22 with the gussets 22 each having two longer side edges 22*a* extending between, and connected to, two shorter end edges 22*b*. In a preferred arrangement, the indicia 15 may be located on one or both of the side edges 22*a* and the labels 17 may be located on one or both of the end edges 22*b*.

Preferably, the napkins 12 are sized to each generally cover one of the panels 20. In this manner, a user can move their head freely about the panel 20 in obtaining a comfortable position with a cleanliness barrier being provided generally across the panel 20. The napkins 12 promote a hygienic mode of testing pillows and/or mattresses at a retail location.

Figure 4:
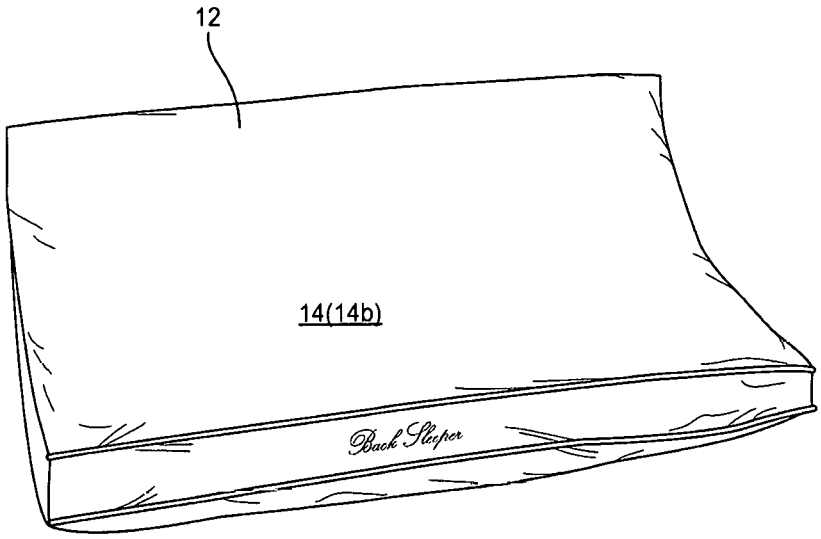
FIG. 4 shows a user placing a napkin atop a pillow in accordance with the subject invention.

The system 1 of the subject invention may be located at a retail location for sleep products, including pillows and mattresses. A person looking to select a pillow and/or mattress chooses one of the pillows 14 based on their individual sleep position preference. The pillow 14*a*, 14*b*, 14*c* corresponding to the individual's preference is provided along with one of the napkins 12. The individual may then seek to test various mattresses and/or pillows for comfort by lying in their preferred sleep position with their head resting on the selected pillow 14*a*, 14*b*, 14*c*. The napkin 12 is placed on top of the selected pillow 14*a*, 14*b*, 14*c* being used by the individual (FIG. 4). The napkin 12 provides a cleanliness barrier between the selected pillow 14*a*, 14*b*, 14*c* and the user's head when testing various mattresses and/or pillows. Once the user is done testing mattresses, the selected pillow 14*a*, 14*b*, 14*c* may be returned for later re-use and the napkin 12 is preferably disposed of. It is also possible for a user to test the pillows 14*a*, 14*b*, 14*c* using the napkin 12 to determine personal preference. In this manner, a user may choose a particular pillow configuration.

The pillows 14 may be of various configurations as discussed herein. In a preferred embodiment, the pillows 14 may be provided with increased height at central portions, as shown in FIG. 2. The fill material 19 is configured to provide the desired shape. More preferably, the panels 20 may be convexly arc-shaped in extending between the end edges 22*b*. Preferably, side edges 20*a* of the panels 20 are generally straight and parallel. The side edges 20*a* may be parallel to the side edges 22*a* of the gussets 22. An area 23 may be defined between and be bounded by the side edge 20*a* and the side edge 22*a* on opposing sides of each of the panels 20. The areas 23 are preferably flat and coplanar with the corresponding side edges 20*a*, 22*a*.

The pillows 14 may be formed in various configurations, including as described in U.S. Provisional Patent Appl. No. 61/499,907, filed Jun. 22, 2011, to the inventor herein, the entire contents of which are incorporated by reference herein.

Figure 5:
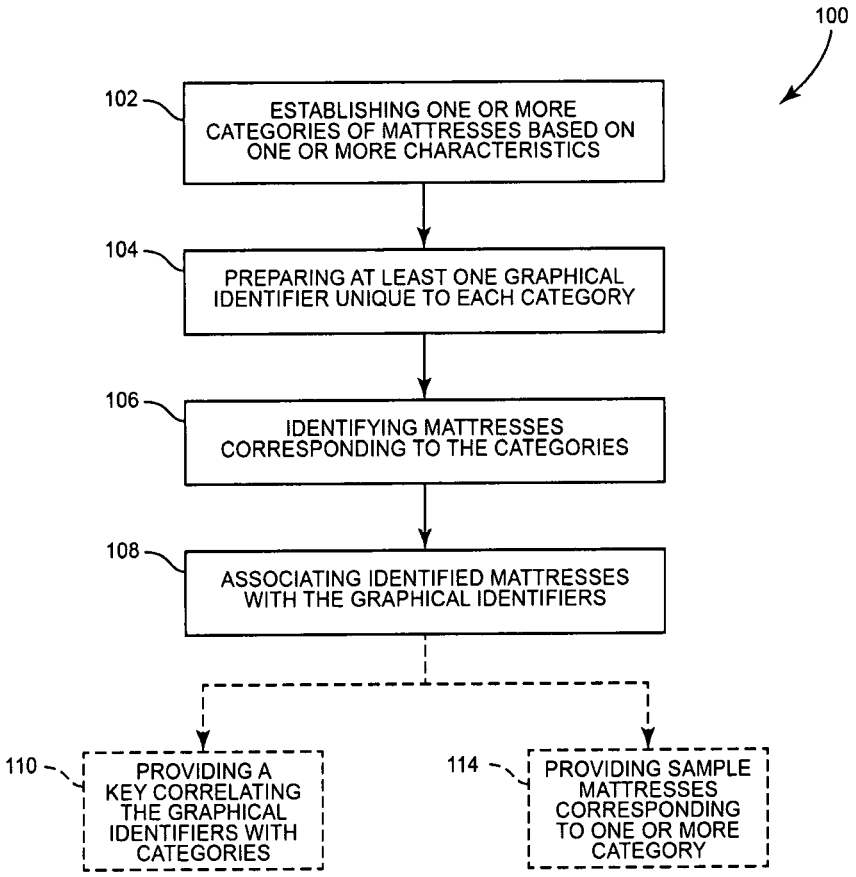
FIG. 5 is a flowchart of method in accordance with the subject invention.
Figure 6A:
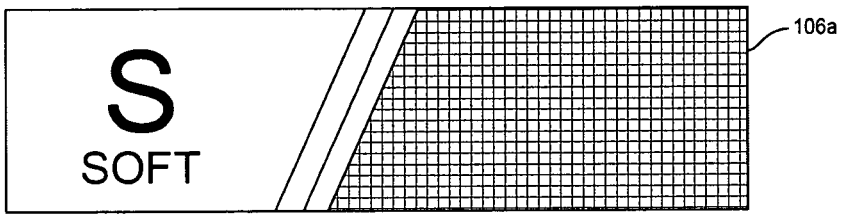
FIGS. 6*a*-6*c* show graphical identifiers useable with the subject invention; and, FIG. 7 shows a representative retail location utilizing the subject invention.
Figure 6B:
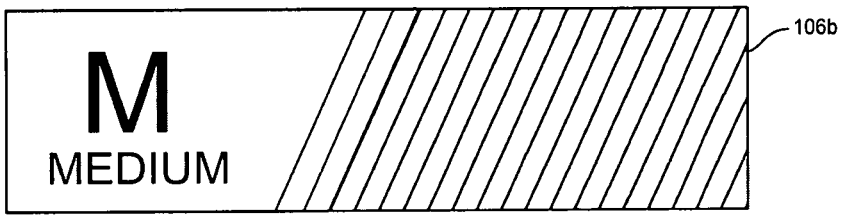
Figure 6C:
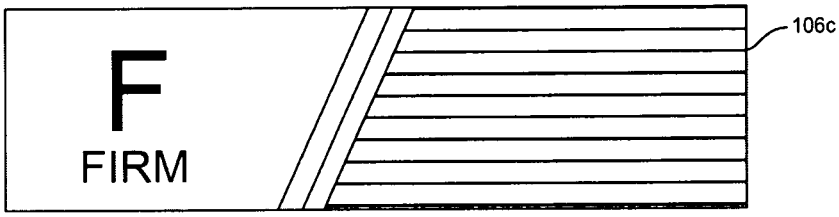

In a further aspect of the subject invention, a method may be provided which is useable to categorize mattresses at a retail location for the convenience of customers. In particular, and with reference to FIG. 5, a method 100 is depicted which includes a step 102 of establishing one or more categories of mattresses based on one or more characteristics. Preferably, the categories are established based on different levels of firmness of the mattresses, such as soft, medium, and firm. The method 100 further includes the step 104 of preparing at least one graphical identifier unique to each of the categories of mattresses. The graphical identifiers preferably include a different color for each of the categories, but may include other graphical representations or indicia (such as symbols and/or lettering). With reference to FIGS. 6*a*-6*c*, by way of non-limiting example, graphical identifiers 106*a*, 106*b*, and 106*c* are shown which may be used to represent soft, medium and firm mattresses. The letters S, M and F may be relied upon as indicators. Also, each of the labels 106*a*, 106*b* and 106*c* may be provided with a different color.

The method 100 also includes step 106 of identifying, at the retail location, mattresses corresponding to the various categories of mattresses. Advantageously, the step 106 may be done at the retail location thereby allowing for a local determination of how to categorize the mattresses, as opposed to a national or regional determination being made for each retail location. This allows for a retail location to observe its customers' preferences and categorize responsively at that location. Once identified, the method 100 includes a step 108 of associating, at the retail location, the identified mattresses with the graphical identifiers unique to the corresponding categories of mattresses. This provides customers with graphical indications of one or more characteristics of the mattresses. In this manner, a customer may readily identify mattresses of interest or lack of interest based on personal preferences. The graphical indicators may be associated with the mattresses by being labels attached or placed on the mattresses and/or by being signage identifying the mattresses corresponding to the relevant characteristics.

Figure 7:
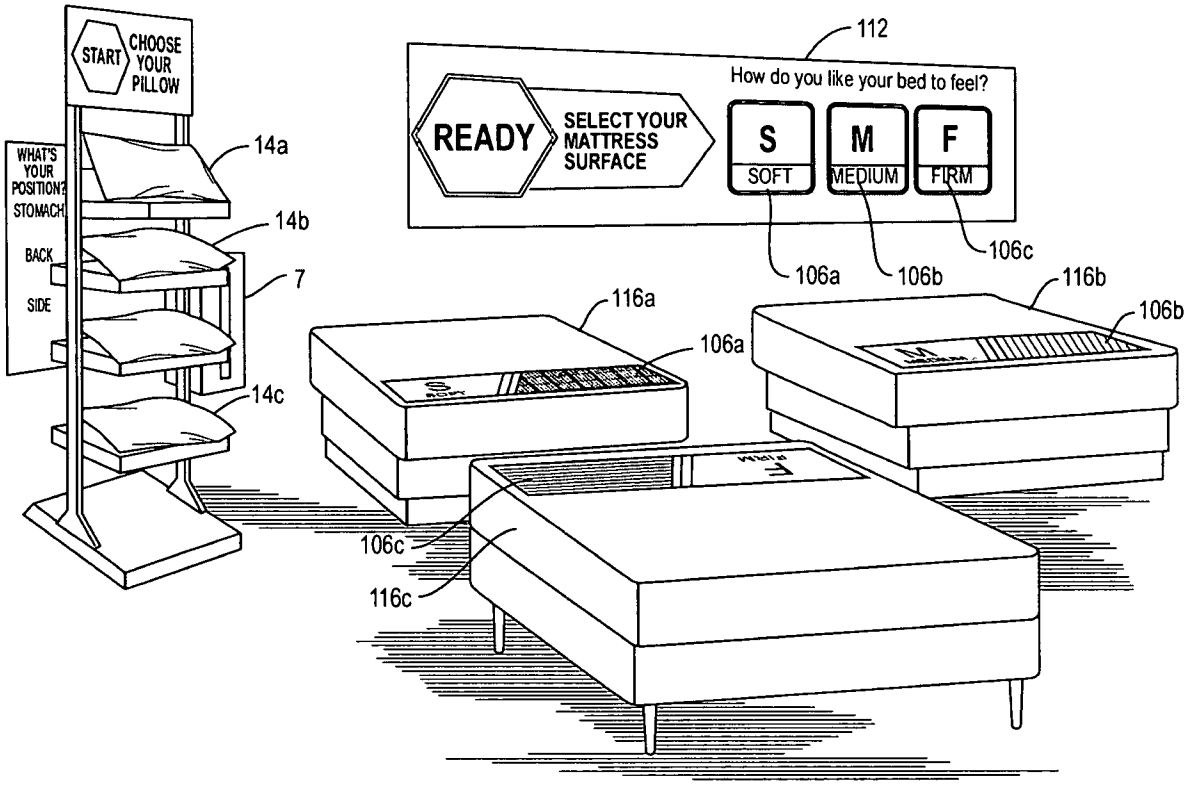

The method 100 may optionally include a step 110 of providing a key 112, at the retail location, correlating the graphical identifiers with the categories of mattresses. As shown in FIG. 7, the key 112 may be in the form of signage showing customers how the graphical identifiers relate to the mattress characteristics. In FIG. 7, the key 112 shows how the graphical identifiers 106*a*, 106*b*, 106*c* from FIG. 7 relate to the firmness characteristics of soft, medium and firm.

The method 100 may also optionally include a step 114 of providing, at the retail location, sample mattresses corresponding to one or more of the categories of mattresses. With reference to FIG. 7, sample mattresses 116*a*, 116*b*, 116*c* may be provided which relate to different categories of mattresses. It is preferred that the sample mattresses 116*a*, 116*b*, 116*c* be located in proximity to each other (e.g, side-by-side or otherwise nearby) to allow a customer to sample the sample mattresses 116*a*, 116*b*, 116*c* in succession or relative succession for comparative purposes. In FIG. 7, the sample mattresses 116*a*, 116*b*, 116*c* are shown as corresponding to the different categories of firmness: soft, medium and firm.

As will be appreciated by those skilled in the art, the method 100 may be used in conjunction with the system 1. In use together, a customer first picks the pillow 14 configured for their style of sleeping and obtains a napkin 12. The customer can then utilize the sample mattresses 116*a*, 116*b*, 116*c* to evaluate the different mattress characteristics to determine personal preferences for certain characteristics—this establishes the categories of mattresses that the customer prefers. Once determined, the customer can seek mattresses at the retail location corresponding to the preferred categories. The customer can sample mattresses by lying thereon with the selected pillow covered by the napkin 12. The customer can sample various mattresses in this manner for comparison. Also, the customer can try different configurations of the pillows 14 in combination with different categories of mattresses for comparative purposes. Once satisfied, the customer may be interested in purchasing a pillow and/or mattress corresponding to preferred versions.

It is also possible to expose customers to additional forms of bedding at retail locations. For example, customers may be exposed to a selection of mattress protectors, preferably at least three different mattress protectors are presented. It is preferred that the mattress protectors be of different constructions and/or quality to afford a customer choice. For example, a selection of mattress protectors may include a mattress protector made of natural fibers (e.g., cotton), which may appeal to environmentally-conscience customers, and/or mattress protectors including treatments or materials for moisture-wicking, such as with treated polyester material, for more performance-conscience customers. By offering selection, customers may be more apt to choose a mattress protector of their liking. Swatches of the mattress protectors may be hung or be otherwise openly displayed for visual or manual inspection. It is also noted that with the use of the napkins 12, bedding-related hygiene is highlighted and that customers may be more conscience of such hygiene during a shopping experience using the napkins 12. This may lead the customers to be more aware of the need for mattress protectors to protect the condition of a mattress.

The system and methods herein may be used in combination with other features such as mattress headers as disclosed in U.S. Provisional Patent Appl. No. 61/515,233, filed Aug. 4, 2011, to the inventor herein, and demonstration jars as disclosed in U.S. Provisional Patent Appl. No. 61/548,249, filed Oct. 18, 2011, to the inventor herein. Both of these patent applications are fully incorporated by reference herein.

It is also possible that the system 1 and the method 100 be used separately or in combination with other methods or systems.

What is claimed is:

1. A method of marketing bedding, the method comprising:

providing pillow napkins, the pillow napkins each comprising a planar sheet having opposite top and bottom surfaces;

positioning a first pillow on a surface of a mattress;

positioning only a first one of the pillow napkins on the first pillow such that an entire bottom surface of the first one of the pillow napkins directly engages an outer surface of the first pillow and the first one of the pillow napkins is not attached to any other pillow napkins;

positioning a head of a consumer on the first one of the pillow napkins to assess the suitability of the first pillow underneath the first one of the pillow napkins;

removing the first one of the pillow napkins from the first pillow;

removing the first pillow from the surface;

positioning a second pillow on the surface, the second pillow being different than the first pillow;

positioning only the first one of the pillow napkins on the second pillow such that the first one of the pillow napkins is not attached to any other pillow napkin; and positioning the head of the consumer on the first one of the pillow napkins to assess the suitability of the second pillow underneath the first one of the pillow napkins.

2. A method as recited in claim 1, wherein the pillow napkins are disposed in a carton and the method further comprises removing one of the pillow napkins from the carton.

3. A method as recited in claim 1, wherein the pillow napkins are wound about a spool that is disposed in a carton and the method further comprises rotating the spool and removing one of the pillow napkins from the carton.

4. A method as recited in claim 1, wherein the pillow napkins are wound about a spool that is disposed in a box comprising a top surface that defines a central opening extending therethrough, one of the pillow napkins extending through the central opening.

5. A method as recited in claim 1, wherein the pillows each include a first panel and a second panel that define a cavity having a fill material therein, the pillow napkins each being configured to removably rest upon the first panel without covering the second panel.

6. A method as recited in claim 1, wherein the pillow napkins are formed from materials selected from a group consisting of textile, paper, cellulosic-based materials, and combinations thereof.

7. A method as recited in claim 1, wherein the pillow napkins are formed from non-woven polyester fibers.

8. A method as recited in claim 1, wherein the pillow napkins are joined by perforated lines of weakness for easy detachment between each pillow napkin.

9. A method as recited in claim 1, wherein the pillow napkins are disposable.

10. A method of marketing bedding, the method comprising:

providing pillow napkins, the pillow napkins each consisting of a planar single-layer sheet having opposite top and bottom surfaces;

providing a first pillow on a mattress;

positioning only a first one of the pillow napkins on the first pillow such that an entire one of the bottom surfaces directly engages an outer surface of the first pillow and the first one of the pillow napkins is not attached to any other pillow napkin;

positioning a head of a consumer on the first one of the pillow napkins to assess the suitability of the first pillow;

providing a second pillow;

positioning only the first one of the pillow napkins on the second pillow such that the first one of the pillow napkins is not attached to any other pillow napkin;

positioning a head of a consumer on the first one of the pillow napkins to assess the suitability of the second pillow.

11. A method as recited in claim 10, wherein the pillow napkins are disposed in a carton and the method further comprises removing one of the pillow napkins from the carton.

12. A method as recited in claim 10, wherein the pillow napkins are wound about a spool that is disposed in a carton and the method further comprises rotating the spool and removing one of the pillow napkins from the carton.

13. A method as recited in claim 10, wherein the pillows directly engage an outer surface of the mattress.

14. A method as recited in claim 10, wherein at least one of the pillows comprises a first panel and a second panel that define a cavity having a fill material therein, the pillow napkins each being configured to removably rest upon the first panel without covering the second panel so as to act as a cleanliness barrier for a person's head.

15. A method as recited in claim 10, wherein the pillow napkins are reusable.

16. A method as recited in claim 1, wherein the pillow napkins are formed from a permeable material.

17. A method as recited in claim 1, wherein the pillow napkins are free of adhesive.

18. A method as recited in claim 1, wherein the pillow is formed from a permeable material.

19. A method as recited in claim 1, wherein no pillow napkins are positioned the first pillow after the first one of the pillow napkins is removed from the first pillow.

20. A method of marketing bedding, the method comprising:

providing a first pillow napkin and a second pillow napkin, the pillow napkins each comprising opposite top and bottom surfaces;

positioning a first pillow on a surface of a mattress;

positioning only the first pillow napkin on the first pillow such that the first pillow napkin is not attached to any other pillow napkins and an entire bottom surface of the first pillow napkin directly engages an outer surface of the first pillow;

positioning a head of a consumer on the first pillow napkin to assess the suitability of the first pillow underneath the first pillow napkin;

removing the first pillow napkin from the first pillow such that no pillow napkins are positioned the first pillow;

removing the first pillow from the surface;

positioning a second pillow on the surface, the second pillow being different than the first pillow;

positioning only the second pillow napkin on the second pillow such that the second pillow napkin is not attached to any other pillow napkins and an entire bottom surface of the second pillow napkin directly engages an outer surface of the second pillow; and positioning the head of the consumer on the second pillow napkin to assess the suitability of the second pillow underneath the second pillow napkin.

* * * * *